US009945564B2

(12) United States Patent
Gao et al.

(10) Patent No.: US 9,945,564 B2
(45) Date of Patent: Apr. 17, 2018

(54) COMBUSTION FURNACE

(71) Applicant: National Chung-Shan Institute of Science and Technology, Taoyuan County (TW)

(72) Inventors: Chung-Hsing Gao, Taoyuan County (TW); Hsun-Ming Hsien, Taoyuan County (TW); Zong-Yi Weng, Taoyuan County (TW); Yann-Long Kuo, Taoyuan County (TW)

(73) Assignee: NATIONAL CHUNG-SHAN INSTITUTE OF SCIENCE AND TECHNOLOGY, Taoyuan County (TW)

( * ) Notice: Subject to any disclaimer, the term of this patent is extended or adjusted under 35 U.S.C. 154(b) by 75 days.

(21) Appl. No.: 14/971,361

(22) Filed: Dec. 16, 2015

(65) Prior Publication Data

US 2016/0209043 A1 Jul. 21, 2016

(30) Foreign Application Priority Data

Jan. 16, 2015 (TW) ..... 104101529 A

(51) Int. Cl.

| | |
|---|---|
| ***F23G 5/42*** | (2006.01) |
| ***F24B 5/02*** | (2006.01) |
| ***F23M 9/04*** | (2006.01) |
| ***F24B 7/00*** | (2006.01) |
| ***F23M 9/02*** | (2006.01) |

(52) U.S. Cl.

CPC ..... *F24B 5/023* (2013.01); *F23G 5/42* (2013.01); *F23M 9/02* (2013.01); *F23M 9/04* (2013.01); *F24B 7/005* (2013.01)

(58) Field of Classification Search

CPC ..... F23G 5/42; F23G 5/24; F23G 5/36; F23G 5/40; F23G 5/50

USPC ..... 126/77

See application file for complete search history.

(56) References Cited

U.S. PATENT DOCUMENTS 466,943 A * 1/1892 Schill et al. ..... F23G 5/42 126/146
835,686 A * 11/1906 Kolla ..... F23G 5/42 126/146
1,263,432 A * 4/1918 Kener ..... F23G 5/245 110/214
1,536,220 A * 5/1925 Jouclard ..... F23G 5/24 110/251
1,891,069 A * 12/1932 Suciu ..... F23G 5/40 110/217

(Continued)

*Primary Examiner* — Avinash Savani
*Assistant Examiner* — Deepak Deean
(74) *Attorney, Agent, or Firm* — Chun-Ming Shih

(57) ABSTRACT

A combustion furnace includes an inner shell, an outer shell, a gas inlet piping and a flame inhibiting cover. The inner shell defines a receiving cavity therein. The inner shell defines a plurality of first gas holes around the periphery of a top portion thereof. The inner shell defines a gas inlet hole at a bottom thereof. The outer shell encloses the inner shell such that a gas flowing space is defined between the inner shell and the outer shell. The gas inlet piping has an opening formed at one end thereof, and the gas inlet piping communicates with the gas flowing space. The flame inhibiting cover is atop the outer shell and the inner shell, and a lower flange of the flame inhibiting cover is below the first gas holes.

14 Claims, 7 Drawing Sheets

(56) References Cited

U.S. PATENT DOCUMENTS

| | | | | | |
|---|---|---|---|---|---|
| 2,124,320 | A * | 7/1938 | Tarment | F23G 5/42 | 110/217 |
| 2,427,480 | A * | 9/1947 | Waterman | F23G 5/42 | 110/251 |
| 2,715,881 | A * | 8/1955 | O'Neil | F23G 5/00 | 110/251 |
| 2,936,724 | A * | 5/1960 | Bishop | F23G 5/24 | 110/254 |
| 2,949,209 | A * | 8/1960 | Schott | F23G 5/42 | 126/25 B |
| 3,361,093 | A * | 1/1968 | Heitz | F23G 5/42 | 110/217 |
| 3,602,163 | A * | 8/1971 | Wahler | F23G 5/40 | 110/203 |
| 3,858,534 | A * | 1/1975 | Berg | F23G 5/085 | 110/234 |
| 5,195,501 | A * | 3/1993 | Ault | F23G 5/42 | 110/241 |
| 5,799,590 | A * | 9/1998 | Noguchi | F23G 5/245 | 110/165 R |
| 6,105,515 | A * | 8/2000 | Kaylor | F23G 5/32 | 110/217 |
| 7,438,003 | B2 * | 10/2008 | Wilfer | F23G 5/42 | 110/224 |
| 2003/0140827 | A1 * | 7/2003 | Wilfer | F23G 5/42 | 110/241 |

* cited by examiner

COMBUSTION FURNACE

BACKGROUND OF THE INVENTION

Field of the Invention

The present invention relates to a combustion furnace, in particular, to a combustion furnace in which the temperature inside the combustion furnace can be maintained to achieve better combustion efficiency.

The Prior Arts

Combustion furnaces burn combustible materials, such as woods, leaves, papers, charcoals or other biomass fuels, so combustion furnaces can be provided to cook or to generate heat. Conventionally, a combustion furnace includes an inner shell and an outer shell. The inner shell is provided as the space for the combustion. Combustion furnaces are provided as heat providers for families. In addition to large combustion furnaces used in households or industries, combustion furnaces are also suitable for outdoor activities, and the volume and weight of combustion furnaces has gradually been reduced to allow for personal combustion furnaces.

However, conventionally, due to insufficient air in the combustion furnace, the ignition time may be too long to allow the materials inside the combustion furnace to ignite. Additionally, when larger sized materials are placed in the combustion furnace during combustion, the flame in the combustion furnace prevents complete combustion, and generates a considerable volume of black smoke and carbon monoxide, while combustion performance is poor.

Additionally, the combustion efficiency of the combustion furnace depends on whether the gas inside the combustion furnace flows fluently to maintain the internal temperature. Conventionally, since the heat convection of the combustion furnace is insufficient and the combustion furnace is devoid of a cover, the flame in the combustion furnace will be ejected upward, so the temperature inside the combustion furnace is insufficient to result in complete combustion. As a result, the conventional combustion furnace combustion process takes longer, and the user needs to add fuel to the combustion furnace continuously, to maintain the internal temperature.

SUMMARY OF THE INVENTION

Consequently, improvement of the combustion furnace's control mechanism to ensure stable combustion, how to reduce the black smoke and dust generated by the combustion furnace, how to maintain the temperature inside the combustion furnace, and how to improve the performance of the combustion furnace, are issues to be addressed by the applicants and related personnel.

To address these issues, the present invention provides a combustion furnace, comprising an inner shell, an outer shell, a gas inlet piping and a flame inhibiting cover. The inner shell defines a receiving cavity therein. The inner shell defines a plurality of first gas holes around the periphery of a top portion thereof. The inner shell defines a gas inlet hole at a bottom portion thereof. The outer shell encloses the inner shell such that a gas flowing space is defined between the inner shell and the outer shell. The gas inlet piping has an opening formed at one end thereof, and the gas inlet piping communicates with the gas flowing space. The flame inhibiting cover is atop the outer shell and the inner shell, and a lower flange of the flame inhibiting cover is below the first gas holes.

In one implementation aspect, the combustion furnace further comprises a baffle sheet assembled to the communicating portion between the gas inlet piping and the gas flowing space.

In one implementation aspect, the opening of the gas inlet piping is wedge-shaped.

In one implementation aspect, the combustion furnace further comprises a flame stopping plate enclosing the lower flange of the flame inhibiting cover.

In one implementation aspect, the width of the flame stopping plate is defined in the range from 1.5 cm to 4 cm.

In one implementation aspect, the inner shell further comprises a plurality of via holes defined there around and between the top portion and the bottom portion thereof.

In one implementation aspect, the diameter of each of the via holes is defined in the range from 0.6 cm to 1 cm.

In one implementation aspect, the inner shell further comprises a plurality of second gas holes defined around the periphery of the bottom portion thereof.

In one implementation aspect, the diameter of each of the second gas holes is defined in the range from 0.6 cm to 1 cm.

In one implementation aspect, the inner wall further comprises a plurality of third gas holes defined at the bottom thereof and defined around the gas inlet hole.

In one implementation aspect, the diameter of each of the third gas holes is defined in the range from 0.9 cm to 1.2 cm.

In one implementation aspect, the inner shell further comprises a plurality of ash removing openings formed at the bottom thereof, wherein the dust removing openings and the third gas holes are alternately arranged around the gas inlet hole.

In one implementation aspect, the combustion furnace further comprises a combustion supporting device in the receiving cavity and above the gas inlet hole. The combustion supporting device comprises a tubular member, a cone-shaped member and a base portion. The cone-shaped member defines an inserting groove therein. A bottom of the tubular member is received in the inserting groove. The base portion is connected to a bottom of the cone-shaped member.

In one implementation aspect, the tubular member further comprises a plurality of vents defined around a top portion thereof.

In one implementation aspect, a distance is defined between the bottom of the cone-shaped member and the gas inlet hole.

In one implementation aspect, the diameter of the inner shell is defined in the range from 40 cm to 70 cm.

In one implementation aspect, the diameter of the outer shell is defined in the range from 42 cm to 75 cm.

In one implementation aspect, the diameter of each of the first gas holes is defined in the range from 0.8 cm to 1.5 cm.

In one implementation aspect, the depth of the inner shell is defined in the range from 60 cm to 130 cm.

In one implementation aspect, the diameter of the gas inlet hole is 5 cm.

In one implementation aspect, the diameter of the lower flange of the flame inhibiting cover is defined in the range from 27 cm to 60 cm.

Accordingly, the first air holes allow the swirl generation when the fresh air enters into the inner shell, so that the gas inside the combustion furnace can flow fluently, the flame in the combustion furnace can be retarded from moving upwardly, and the temperature inside the combustion furnace can be maintained to improve the combustion performance of the combustion furnace. Additionally, the inlet gas hole at the bottom portion of the inner shell facilitates fresh air entering into the inner shell to mix with the fuels, so that complete combustion is accomplished.

Additionally, the wedge-shaped opening and the baffle sheet allows the air to generate an air flow when the air enters into the gas inlet piping, so that the air flow facilitates more fresh air entering into the inner shell to achieve better combustion performance.

Detailed description of the characteristics and the advantages of the present invention is shown in the following embodiments, the technical content and the implementation of the present invention should be readily apparent to any person skilled in the art from the detailed description, and the purposes and the advantages of the present invention should be readily understood by any person skilled in the art with reference to content, claims and drawings in the present invention.

BRIEF DESCRIPTION OF THE DRAWINGS

The present invention will become more fully understood from the detailed description given herein below for illustration only, and thus not limitative of the present invention, wherein.

DETAILED DESCRIPTION OF THE PREFERRED EMBODIMENT

Figure 1:
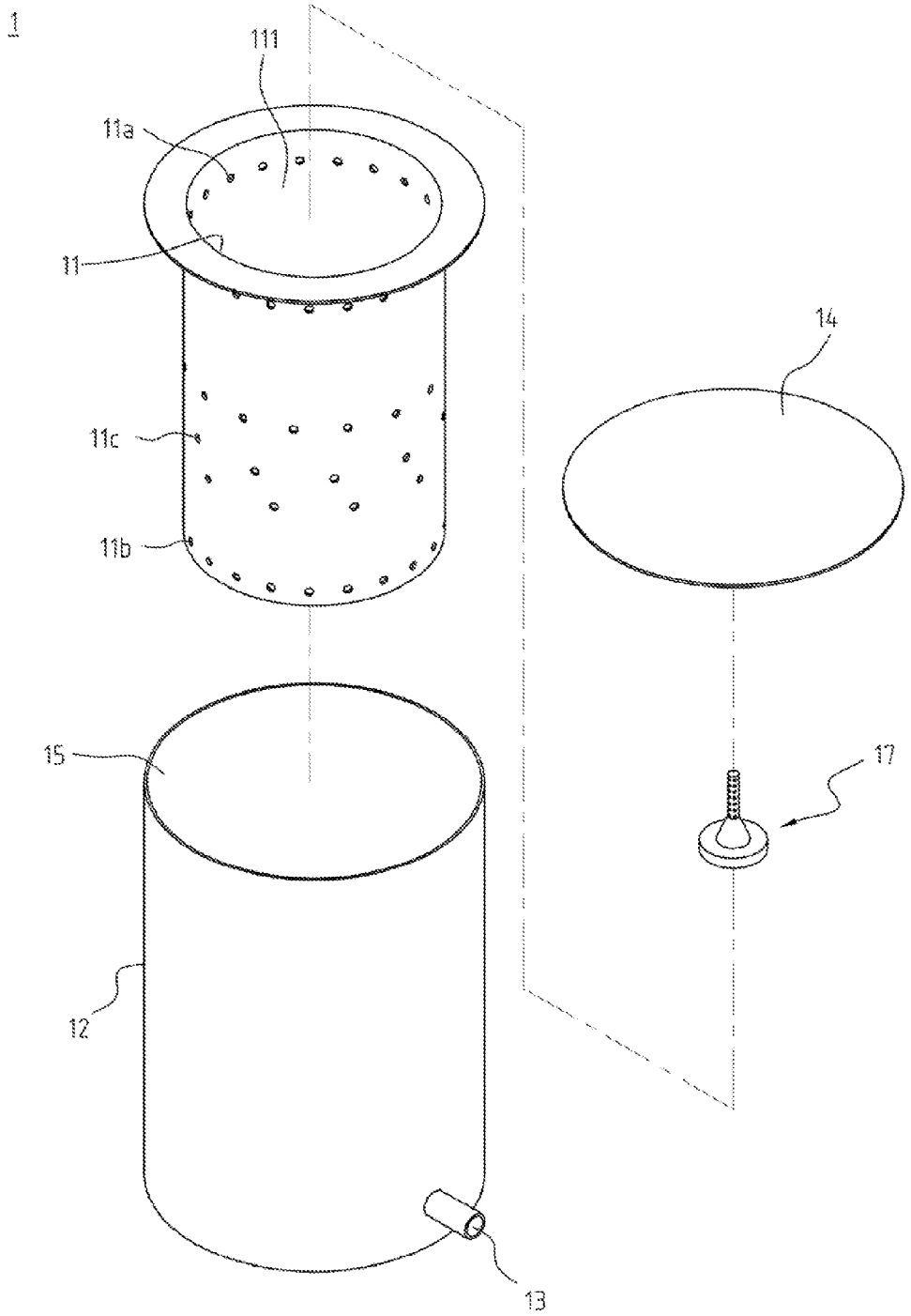
FIG. 1 is an exploded view of a first embodiment of a combustion furnace according to the present invention.
Figure 2:
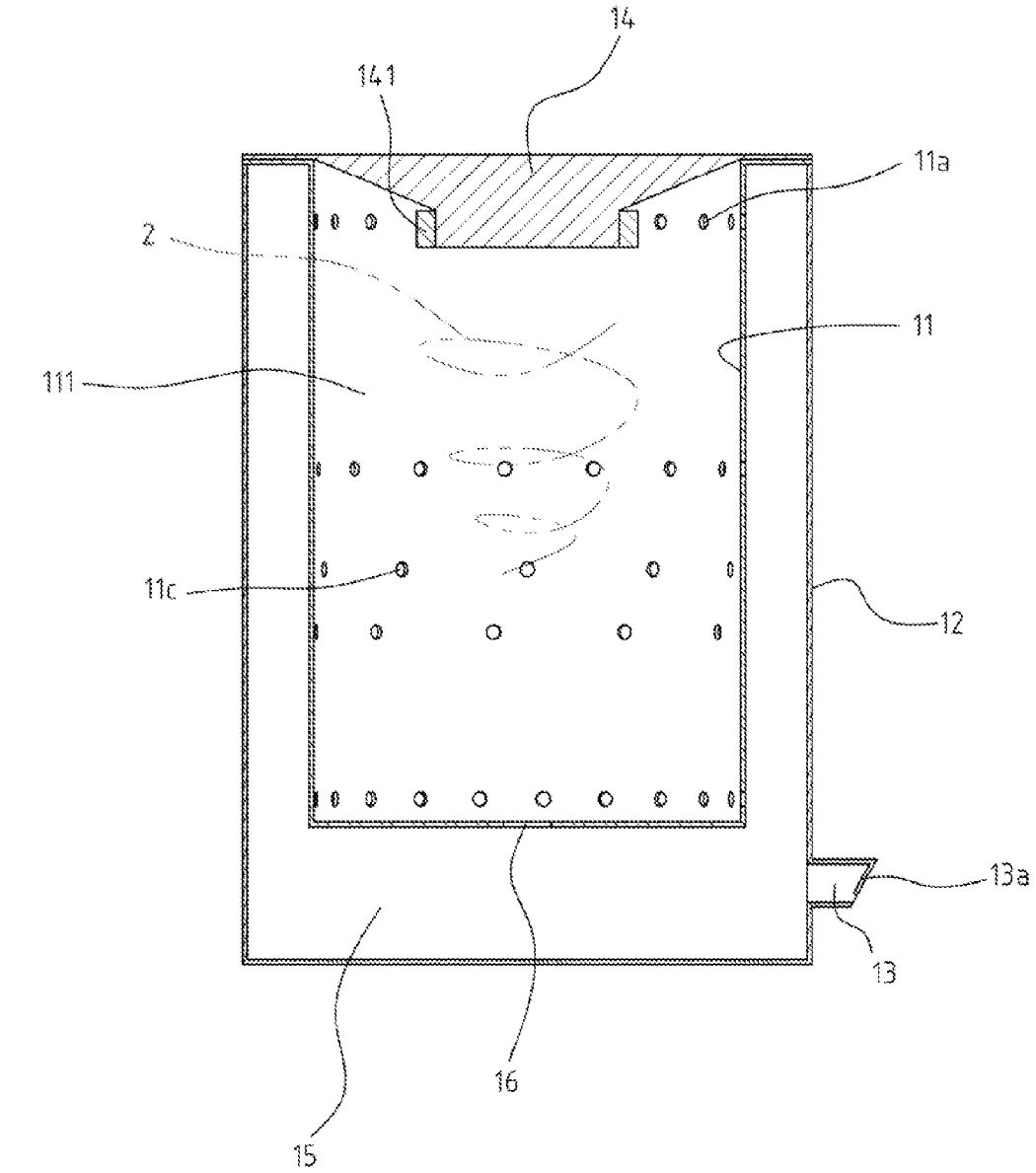
FIG. 2 is a sectional view of a second embodiment of a combustion furnace according to the present invention.

Please refer to FIG. 1, illustrating an exploded view of a first embodiment of a combustion furnace 1 according to the present invention. The combustion furnace 1 comprises an inner shell 11, an outer shell 12, a gas inlet piping 13 and a flame inhibiting cover 14. The inner shell 11 defines a receiving cavity 111 therein. The inner shell 11 defines a plurality of first gas holes 11*a* around the periphery of a top portion thereof. The inner shell 11 defines a gas inlet hole 16 at a bottom thereof. The outer shell 12 encloses the inner shell 11 such that a gas flowing space 15 is defined between the inner shell 11 and the outer shell 12. The diameter of the inner shell 11 may be, but not limited to, in the range from 40 cm to 70 cm. The depth of the inner shell 11 may be, but not limited to, in the range from 60 cm to 130 cm. The diameter of the outer shell 12 may be, but not limited to, in the range from 42 cm to 75 cm. The gas inlet piping 13 has an opening formed at one end thereof, and the gas inlet piping 13 communicates with the gas flowing space 15, so that the gas came from the gas inlet piping 13 can be guided to the receiving cavity 111. The flame inhibiting cover 14 is atop the outer shell 12 and the inner shell 11, wherein the diameter of a lower flange of the flame inhibiting cover 14 may be, but not limited to, in the range from 27 cm to 60 cm. The flame inhibiting cover 14 is closely mated with the inner shell 11 and the outer shell 12. That is, the flame inhibiting cover 14 encloses the top of the receiving cavity 111 and the top of the gas flowing space 15, as shown in FIG. 2. A lower flange of the flame inhibiting cover 14 is below the first gas holes 11*a*.

Accordingly, the first air holes 11*a* are defined around the periphery of the top portion of the inner shell 11, so that the gas inside the combustion furnace 1 flows fluently to generate a swirl 2 to retard the flame in the combustion furnace 1 from moving upwardly or ejecting upwardly, and the temperature inside the combustion furnace 1 can be maintained to improve the combustion performance of the combustion furnace 1. The diameter of each of the first air holes 11*a* may be, but not limited to, in the range from 0.8 cm to 1.5 cm. Additionally, the inlet gas hole 16 is defined at the bottom portion of the inner shell 11, so that fresh air can enter into the inner shell 11 to mix with the fuels (combustible materials), inside the inner shell 11 to accomplish complete combustion. The diameter of the gas inlet hole 16 may be, but not limited to, 5 cm. Preferably, the lower flange of the flame inhibiting cover 14 is below the first air holes 11*a*.

Figure 3:
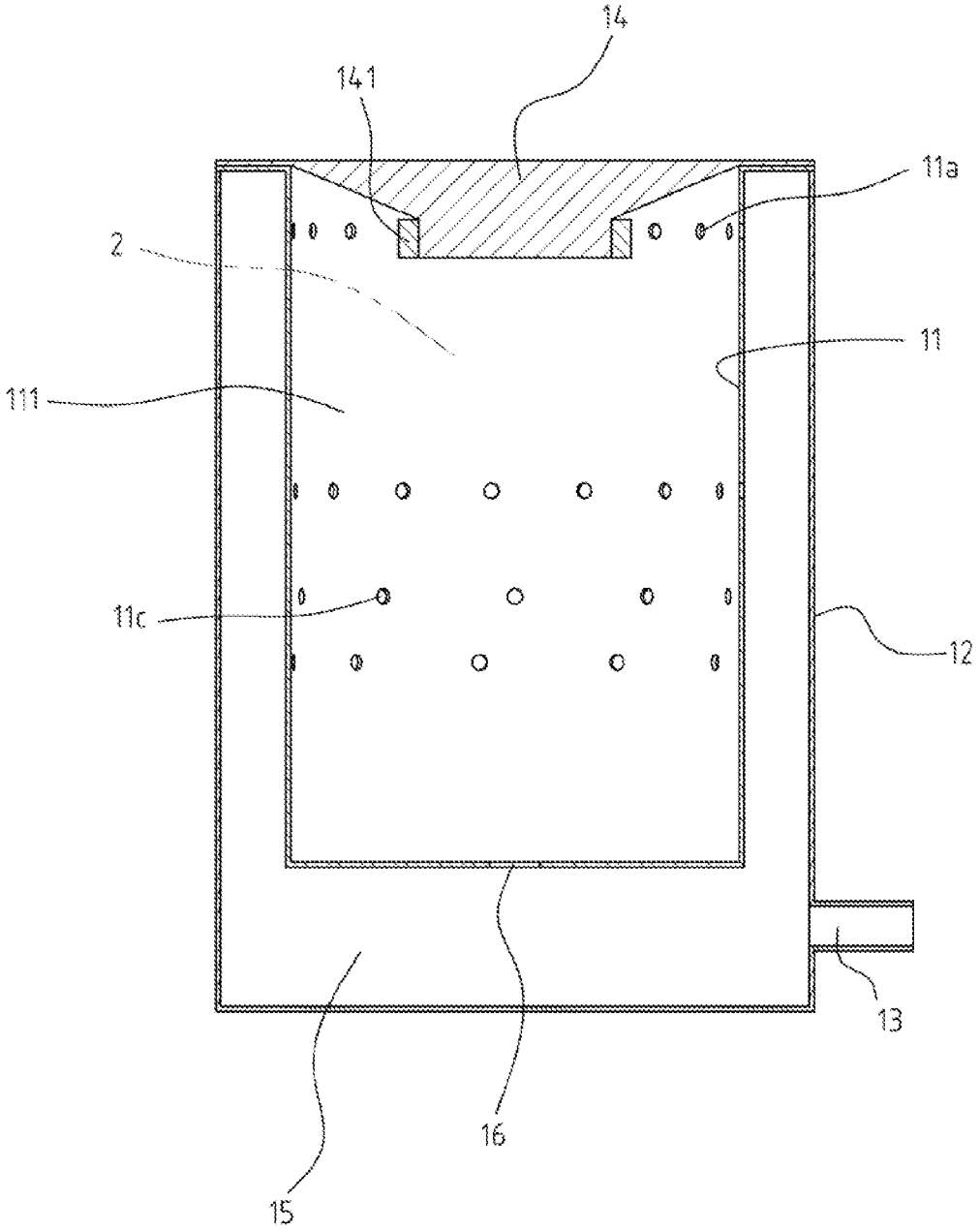
FIG. 3 is a sectional view of a third embodiment of a combustion furnace according to the present invention.
Figure 4:
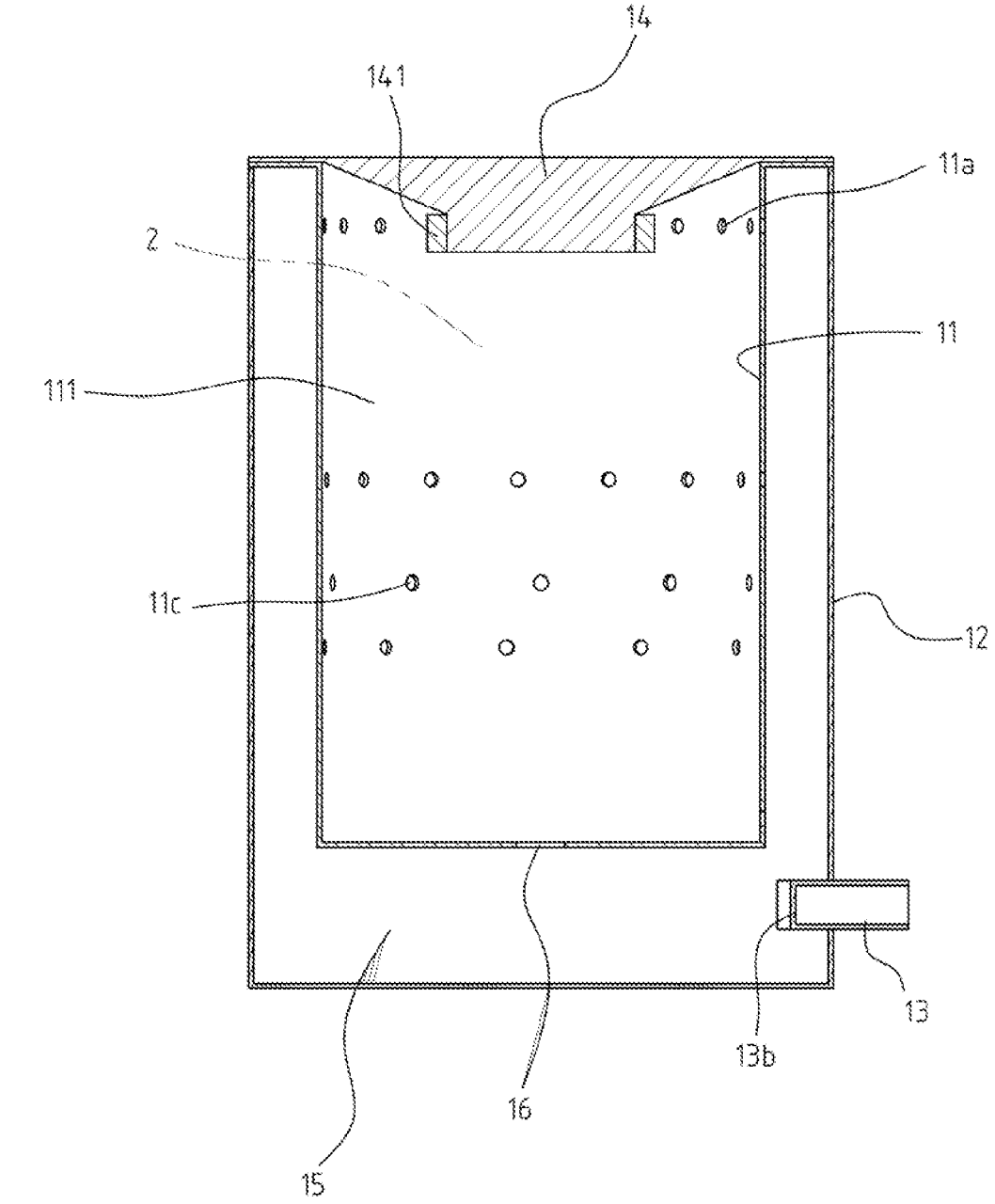
FIG. 4 is a sectional view of a fourth embodiment of a combustion furnace according to the present invention.

FIG. 2 is a sectional view of a second embodiment of a combustion furnace 1 according to the present invention. FIG. 3 is a sectional view of a third embodiment of a combustion furnace 1 according to the present invention. FIG. 4 is a sectional view of a fourth embodiment of a combustion furnace 1 according to the present invention. Please refer to FIG. 2 to FIG. 4, in which embodiments the inner shell 11 further defines a plurality of via holes 11*c* there around. The via holes 11*c* are between the top portion and the bottom portion of the inner shell 11. Similarly, the via holes 11*c* allow fresh air to enter into the inner shell 11 to mix with the combustible materials inside the inner shell 11, so that the materials inside the inner shell 11 which are locate at a combustion area (namely, the receiving cavity 111) can be burned completely. In some embodiment, the diameter of each of the via holes 11*c* may be, but not limited to, in the range from 0.6 cm to 1 cm.

In addition, in some embodiments, the combustion furnace 1 further comprises a flame stopping plate 141 enclosing the lower flange of the flame inhibiting cover 14. The flame stopping plate 141 is provided for protecting the flame inhibiting cover 14 from suffering the flame coming up from the combustion area. In some embodiments, the width of the flame stopping plate 141 may be, but not limited to, in the range from 1.5 cm to 4 cm.

Please refer to FIG. 2, in which embodiment the inner shell 11 further defines a plurality of second gas holes 11*b* around the periphery of the bottom portion thereof. Again, the second gas holes 11*b* are provided to induce the communication of fresh air so as to improve the combustion performance of the combustion furnace 1. In some embodiments, the diameter of each of the second gas holes 11*b* may be, but not limited to, in the range from 0.6 to 1 cm.

Additionally, as shown in FIG. 2, in this embodiment, the opening of the gas inlet piping 13 is wedge-shaped. The wedge-shaped opening 13*a* of the gas inlet piping 13 allows the air to generate an air flow when the air enters into the gas inlet piping 13. Next, with the configurations of the gas inlet hole 16 and the gas flowing space 15, the air flow facilitates more fresh air entering into the inner shell 11 to achieve better combustion performance.

Alternatively, the opening of the gas inlet piping 13 can be unprocessed, as shown in FIG. 3.

Figure 5:
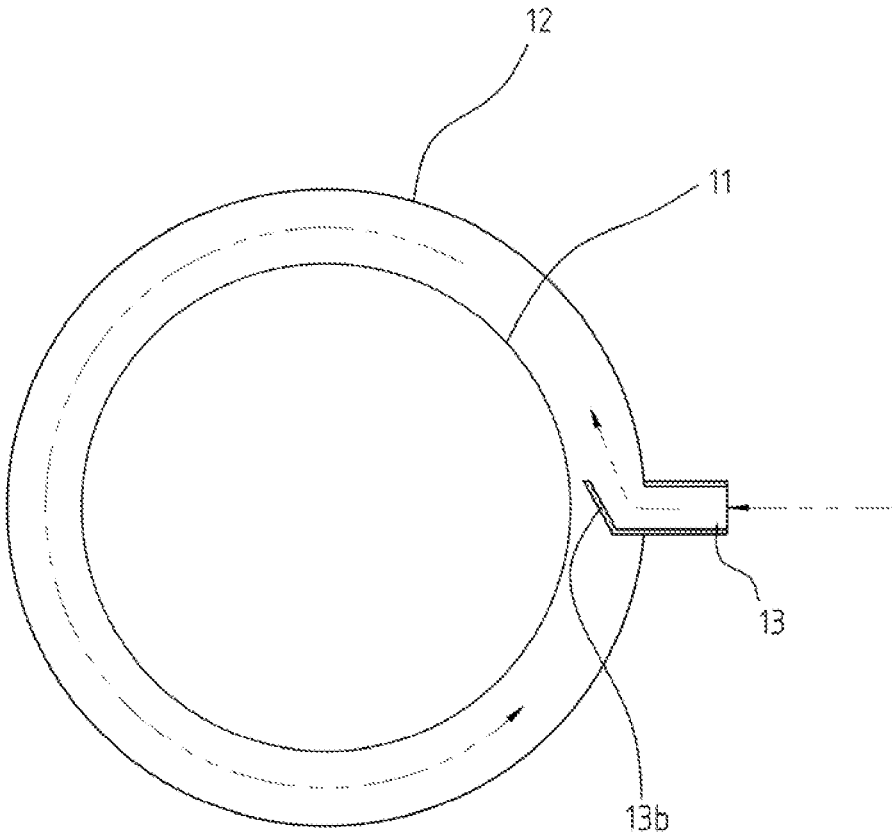
FIG. 5 is a top view of the fourth embodiment of the combustion furnace according to the present invention.

Please refer to FIG. 4 and FIG. 5, in which embodiment the gas inlet piping 13 further comprises a baffle sheet 13*b* assembled to the communicating portion between the gas inlet piping 13 and the gas flowing space 15. As shown in FIG. 5, the baffle sheet 13*b* is inclinedly assembled to allow the air to generate an air flow when the air enters into the gas inlet piping 13. Next, with the configurations of the gas inlet hole 16 and the gas flowing space 15, the air flow facilitates more fresh air entering into the inner shell 11 to achieve better combustion performance.

Figure 6:
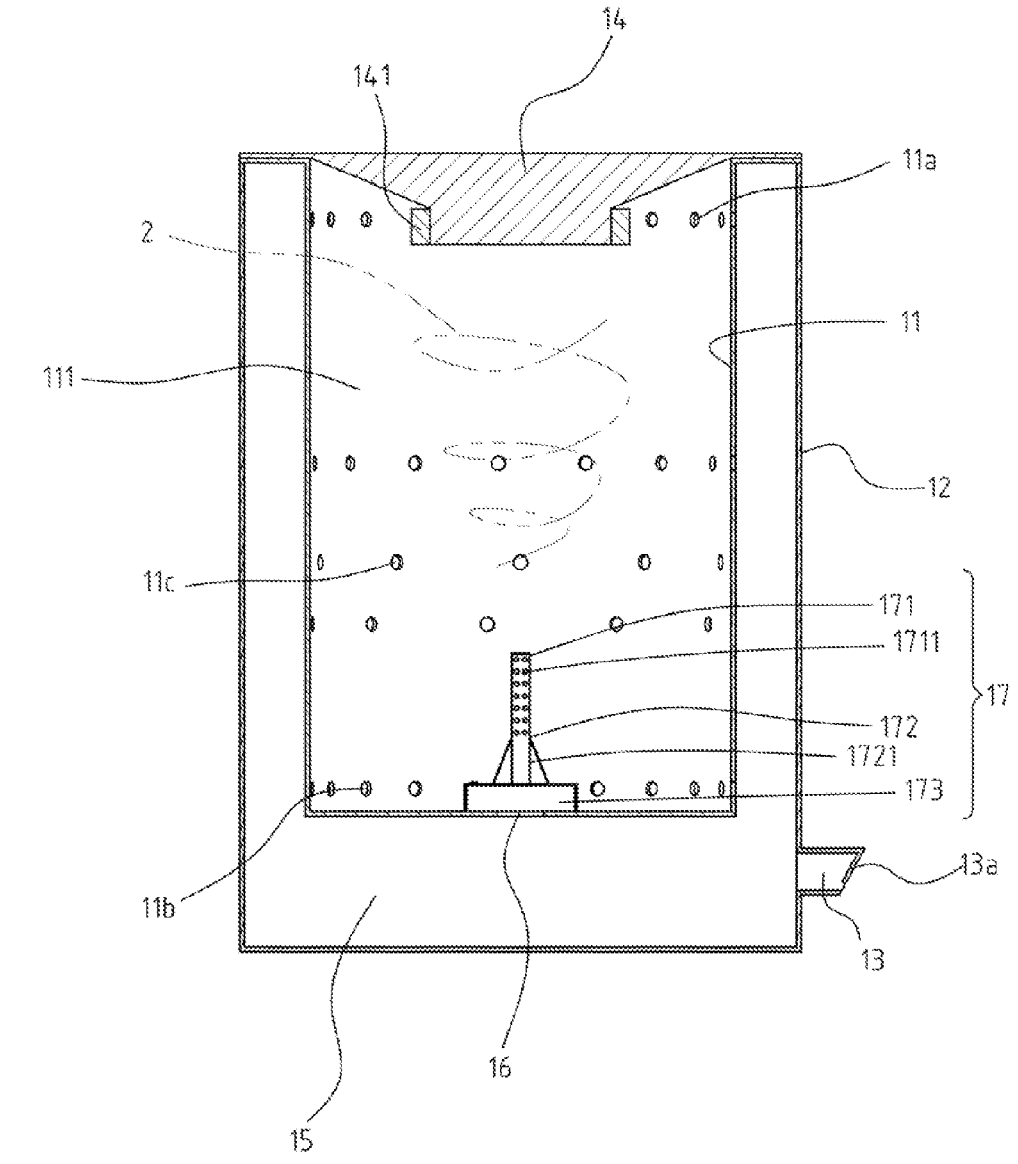
FIG. 6 is a sectional view of the first embodiment of the combustion furnace according to the present invention.

Please refer to FIG. 6, illustrating a sectional view of the fourth embodiment of the combustion furnace 1 according to the present invention. The combustion furnace 1 further comprises a combustion supporting device 17 in the receiving cavity 111 and above the gas inlet hole 16. The combustion supporting device 17 comprises a tubular member 171, a cone-shaped member 172 and a base portion 173. The cone-shaped member 172 defines an inserting groove 1721 therein, such that a bottom of the tubular member 171 is received in the inserting groove 1721, as shown in FIG. 5. The base portion 173 is connected to a bottom of the cone-shaped member 172. The tubular member 171 further defines a plurality of vents 1711 around a top portion thereof.

Powdered ceramic materials can be placed into the space defined by the outer surface of the lower portion of the tubular member 171 and an inner wall of the cone-shaped member 172 to maintain the temperature of the combustion furnace 1, and ensure stable combustion. The ceramic materials are heat resistant, and may be made of, but are not limited to, zirconium oxide, aluminum oxide. In a preferred embodiment, a distance is defined between the bottom of the cone-shaped member 172 and the gas inlet hole 16. The distance is defined in the range from 0.3 cm to 20 cm. Preferably, the distance is defined in the range from 1 cm to 5 cm.

Figure 7:
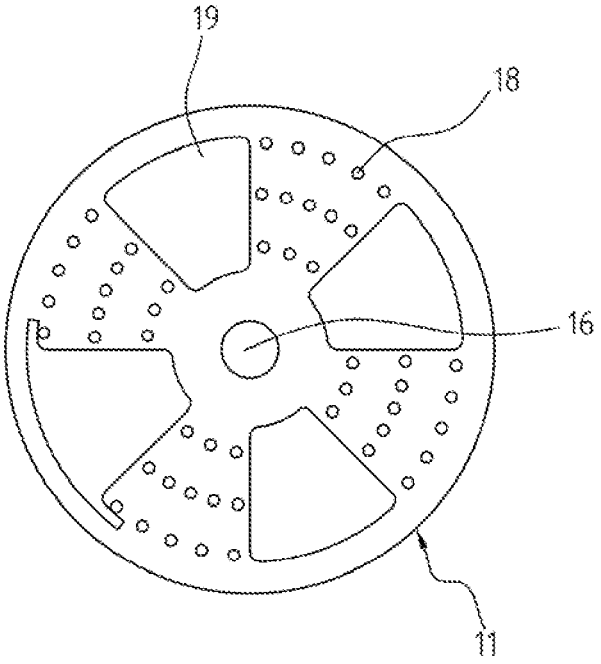
FIG. 7 is a bottom view of an inner shell of an exemplary embodiment of a combustion furnace according to the present invention.

Please refer to FIG. 7, illustrating an inner shell 11 of an exemplary embodiment of a combustion furnace 1 according to the present invention. The inner shell 11 further comprises a plurality of third gas holes 18 defined at the bottom thereof and defined around the gas inlet hole 16. The diameter of each of the third gas holes 18 may be, but not limited to, in the range from 0.9 cm to 1.2 cm. The third gas holes 18 facilitate the air communication between the inside of the inner shell 11 and the outside of the inner shell 11 to promote the combustion in the inner shell 11.

Moreover, in some embodiments, the inner shell 11 further comprises a plurality of ash removing openings 19 formed at the bottom thereof, wherein the ash removing openings 19 and the third gas holes 18 are alternately arranged around the gas inlet hole 16. Accordingly, after use, the user can remove ashes left in the combustion furnace 1 from the ash removing openings 19 conveniently.

Based on the above, the combustion furnace 1 according to the present invention may comprise the combustion supporting device 17 or may not. Details of the structure of the combustion furnace 1 are described as above. Here, the combustion furnace 1 devoid of the combustion supporting device 17 is preferably to be carried out by the embodiment shown in FIG. 2, and the combustion furnace 1 comprising the combustion supporting device 17 is preferably to be carried out by the embodiment shown in FIG. 6.

Accordingly, the first air holes allow the swirl generation when the fresh air enters into the inner shell, so that the gas inside the combustion furnace can flow fluently, the flame in the combustion furnace can be retarded from moving upward, and the temperature inside the combustion furnace can be maintained to improve the combustion performance of the combustion furnace. Additionally, the inlet gas hole at the bottom portion of the inner shell facilitates fresh air entering into the inner shell to mix with the fuels, so that complete combustion is accomplished.

Additionally, the wedge-shaped opening and the baffle sheet allows the air to generate an air flow when the air enters into the gas inlet piping, so that the air flow facilitates more fresh air entering into the inner shell to achieve better combustion performance.

While the present invention has been described by the way of example and in terms of the preferred embodiments, it is to be understood that the present invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A combustion furnace, comprising:

an inner shell, defining a receiving cavity therein, the inner shell defining a plurality of first gas holes around the periphery of a top portion thereof, the inner shell defining a gas inlet hole at a bottom portion thereof;

an outer shell, enclosing the inner shell such that a gas flowing space is defined between the inner shell and the outer shell;

a gas inlet piping having an opening formed at one end thereof and the gas inlet piping communicating with the gas flowing space;

a flame inhibiting cover including a conical portion and a cylindrical portion extending downwardly from the conical portion, a lower edge of the cylindrical portion being disposed below the first gas holes; and a combustion supporting device disposed in the receiving cavity and above the gas inlet hole, the combustion supporting device comprising:

a tubular member;

a cone-shaped member, defining an inserting groove therein, a bottom of the tubular member received in the inserting groove; and a base portion, connected to a bottom of the cone-shaped member, wherein a powdered ceramic material is placed into a space defined by an outer surface of the lower portion of the tubular member and an inner wall of the cone-shaped member to maintain the temperature of the combustion furnace;

wherein a flame stopping plate encloses and is in direct contact with an outer surface of the cylindrical portion for preventing a flame coming out from the receiving cavity.

2. The combustion furnace according to claim 1, further comprising a baffle sheet assembled to a communicating portion between the gas inlet piping and the gas flowing space.

3. The combustion furnace according to claim 1, wherein the opening of the gas inlet piping is wedge-shaped.

4. The combustion furnace according to claim 1, wherein the width of the flame stopping plate is defined in the range from 1.5 cm to 4 cm.

5. The combustion furnace according to claim 1, wherein the inner shell further comprises a plurality of via holes defined therearound and between the top portion and the bottom portion thereof, and wherein the diameter of each of the via holes is defined in the range from 0.6 cm to 1 cm.

6. The combustion furnace according to claim 1, wherein the inner shell further comprises a plurality of second gas holes defined around the periphery of the bottom portion thereof, and wherein the diameter of each of the second gas holes is defined in the range from 0.6 cm to 1 cm.

7. The combustion furnace according to claim 1, wherein the inner shell further comprises a plurality of third gas holes defined at the bottom thereof and defined around the gas inlet hole, and wherein the diameter of each of the third gas holes is defined in the range from 0.9 cm to 1.2 cm.

8. The combustion furnace according to claim 1, wherein the inner shell further comprises a plurality of ash removing openings formed at the bottom thereof, wherein the dust removing openings are arranged around the gas inlet hole.

9. The combustion furnace according to claim 1, wherein the diameter of the inner shell is defined in the range from 40 cm to 70 cm, wherein the depth of the inner shell is defined in the range from 60 cm to 130 cm, and wherein the diameter of the outer shell is defined in the range from 42 cm to 75 cm.

10. The combustion furnace according to claim 1, wherein the diameter of each of the first gas holes is defined in the range from 0.8 cm to 1.5 cm.

11. The combustion furnace according to claim 1, wherein the diameter of the gas inlet hole is 5 cm.

12. The combustion furnace according to claim 1, wherein the diameter of the lower flange of the flame inhibiting cover is defined in the range from 27 cm to 60 cm.

13. The combustion furnace according to claim 1, wherein the tubular member further comprises a plurality of vents defined around a top portion thereof.

14. The combustion furnace according to claim 1, wherein a distance is defined between the bottom of the cone-shaped member and the gas inlet hole.

* * * * *